US007823293B2

(12) United States Patent
Walmsley et al.

(10) Patent No.: US 7,823,293 B2
(45) Date of Patent: Nov. 2, 2010

(54) PLUNGE-CUT CIRCULAR SAW

(75) Inventors: Neil Walmsley, Ferryhill (GB); Mike Wilson, Crook (GB)

(73) Assignee: Black & Decker Inc., Newark, DE (US)

( * ) Notice: Subject to any disclaimer, the term of this patent is extended or adjusted under 35 U.S.C. 154(b) by 490 days.

(21) Appl. No.: 11/804,805

(22) Filed: May 21, 2007

(65) Prior Publication Data

US 2007/0277660 A1 Dec. 6, 2007

(30) Foreign Application Priority Data

Jun. 2, 2006 (EP) ..... 06114904

(51) Int. Cl.
*B27B 9/02* (2006.01)
*B27B 5/29* (2006.01)

(52) U.S. Cl. ..... 30/375; 30/377; 83/471.2; 83/473; 83/490

(58) Field of Classification Search ..... 30/371, 30/375, 377, 388; 83/471.2, 490, 473
See application file for complete search history.

(56) References Cited

U.S. PATENT DOCUMENTS 3,242,953 A * 3/1966 McCarty et al. ..... 30/375
3,262,472 A * 7/1966 McCarty et al. ..... 30/376
4,079,648 A * 3/1978 Chappell ..... 83/490
4,774,866 A * 10/1988 Dehari et al. ..... 83/478
4,805,504 A * 2/1989 Fushiya et al. ..... 83/397
4,934,233 A * 6/1990 Brundage et al. ..... 83/397
5,161,443 A * 11/1992 Huang ..... 83/169
5,239,756 A * 8/1993 Matzo et al. ..... 30/371
5,848,472 A * 12/1998 Eto et al. ..... 30/375
5,960,691 A * 10/1999 Garuglieri ..... 83/471.2
2005/0155232 A1* 7/2005 Bocka et al. ..... 30/377
2005/0217124 A1* 10/2005 Fuchs et al. ..... 30/377
2008/0244910 A1* 10/2008 Patel ..... 30/123
2009/0049970 A1* 2/2009 Thomas et al. ..... 83/440.2
2009/0133559 A1* 5/2009 Sargeant et al. ..... 83/508.2

FOREIGN PATENT DOCUMENTS

DE 37 29 102 A1 * 4/1988
DE 41 23 315 A1 * 1/1993
DE 196 35 527 A1 * 2/1998
EP 1 862 275 A1 * 12/2007

* cited by examiner

*Primary Examiner*—Hwei-Siu C Payer
(74) *Attorney, Agent, or Firm*—Michael Aronoff; Adan Ayala

(57) ABSTRACT

The present invention provides a plunge-cut action circular saw having a double pivot hinge mechanism. Problems associated with this hinge mechanism, in particular axial end flow are reduced by urging a component of the hinge against a fixed component of the saw, such as a base plate component or the like. The urging force is applied by a resilient member, such as a spring washer.

2 Claims, 2 Drawing Sheets

PLUNGE-CUT CIRCULAR SAW

FIELD OF THE INVENTION

This application claims priority to European Patent Application No. 06114904.3 filed Jun. 2, 2006. The entire contents of that application are expressly incorporated herein by reference thereto.

BACKGROUND OF THE INVENTION

The present invention relates to a circular saw. In particular, but not exclusively, the present invention relates to a circular saw having a plunge-cut action and hinge mechanism arranged to allow relative movement of the circular saw body with respect to the saw's base plate.

BRIEF SUMMARY OF THE INVENTION

Plunge-cut action circular saws are known. This type of saw is within the family of saws known as circular saws. Plunge cut circular saws are generally hand operated electrically powered portable saws. Typically they comprise an electric motor housed in a moulded plastic housing having an integral handle and switch by which the motor is operated and the saw is plunged into a work piece by the operator. A saw blade can be attached to an output spindle of the motor or associated gearbox. The blade is housed in a shroud. The saw also comprises a base plate having an underside surface which is used to engage a work-piece. The base plate typically has an aperture through which the saw blade passes during use.

Plunge-cut action of the saw is achieved by a pivot or hinge mechanism arranged to allow movement of the housing relative to the base plate, between a parked and plunged position. Thus, because the saw blade is coupled to the motor (generally via a gearbox), the saw blade is moveable with respect to the base plate. In a parked position, the saw blade is completely accommodated in the blade shroud and does not extend through the aperture in the base plate. In a plunged position, the saw blade extends from the shroud passing though the aperture. A spring is arranged to urge the saw into the parked position. Thus, the saw can be placed on a work-piece, the motor can be activated and the blade then plunged into the work-piece to commence cutting of the work-piece.

Typically, the hinge is disposed on the base plate either forward of the saw blade, or behind the saw blade with respect to the intended cut direction. Thus, the motor housing and handle follow an arcuate path as the saw is moved from the parked position to the plunged position. This path causes a change in the angle of the handle during plunging with respect to the work-piece or operator, which can be quite uncomfortable and not particularly ergonomic for the operator.

DE 19635527 (Black and Decker Inc.) discloses a plunge-action circular saw having a swing-arm hinge arrangement, or double pivot. As a result, the angle of the handle relative to the base plate can be arranged to change by a minimum amount. Problems exist with this type of hinge mechanism in that manufacturing tolerances of the hinge components must be relatively accurate in order to avoid or minimise relative lateral movement of the motor housing and base plate, with respect to the intended direction of cut, as the saw is plunged.

The present invention aims to ameliorate problems associated with the prior art. In summary, the present invention aims to provide a plunge-action circular saw which utilises a swing-arm hinge mechanism to improve ergonomics and comfort to the operator, and an improvement upon the swing-arm mechanism described above and in DE 19635527.

The present invention provides an electrically powered, hand-held circular saw, comprising a motor housing for housing a motor having a driven output coupled to a gearbox or drive spindle, attachment means coupled to the drive spindle for fixedly attaching a blade to the drive spindle, a base plate having a bottom surface arranged to engage with a work-piece or guide rail, a hinge mechanism which couples the motor housing or gearbox to the base plate such that the drive spindle is moveable relative to the base plate between a parked position and plunged position, wherein when the drive spindle is in the parked position a saw blade is accommodated in a blade shroud, and when the drive spindle is in the plunged position a portion of a saw blade extends from the blade shroud, and wherein the hinge mechanism comprises at least one arm being moveably coupled at a first end to the base plate, and being movably coupled at a second end to either the motor housing or gearbox, characterised in that the hinge mechanism further comprises a rod arranged to cooperate with a bearing, and a resilient member arranged to urge a surface of the bearing against a rod surface.

The present invention also provides a circular saw hinge mechanism arranged to movably couple a motor housing or gearbox of a circular saw to a base plate, the hinge mechanism comprising at least one arm being moveably coupled at a first end to the base plate, and being movably coupled at a second end to either the motor housing or gearbox, characterised in that the hinge mechanism further comprises a rod arranged to cooperate with a bearing, and a resilient member arranged to urge a surface of the bearing against a rod surface.

These arrangements described above have been found to overcome or minimise problems associated with swing-arm hinge mechanism. In particular, axial movement of the swing-arms along hinge pins has been found to be problematic and the present invention can reduce or overcome this problem. (Such axial movement occurs as the saw is plunged and result in the swing-arm following a helical or corkscrew path).

Preferably, the rod has a first diameter which cooperates with an inner diameter of the bearing and a second larger diameter on side of the first diameter, and wherein the resilient member is disposed on the inner diameter of the rod.

Preferably, the resilient member engages with a portion of the rod disposed between the inner and second diameter. Furthermore, the resilient member is arranged to exert an axial force parallel to the longitudinal axis of the rod. Preferably, the resilient member is a coil spring or compression washer.

Preferably, the force exerted by the resilient member is between 20N and 100N. More preferably, the force exerted by the resilient member is between 30N to 60N or between 50N and 75N. Most preferably, the force exerted by the resilient member is 60N (+/−5N).

BRIEF DESCRIPTION OF THE INVENTION

Embodiments of the present invention are now described by way of example, and with reference to the following drawings, of which:

DETAILED DESCRIPTION OF THE INVENTION

Embodiments of the present invention aim to improve upon the hinge arrangement disclosed DE 19635527. The main problem with the hinge arrangement disclosed in this document is associated with the so-called "axial end flow" phenomenon. This occurs as the saw is moved from a parked position (with the blade fully housed in the shroud) to a plunged position (where the blade extends through a base plate aperture for cutting of a work-piece). With this system we have found that the operator has to be careful to ensure a force is applied to the saw handle only in a direction in the plane of the blade. If a component of a plunging force exerted by the user on the saw exists outside this plane, then the motor housing can move laterally with respect to the base plate thereby causing axial end flow. In effect, one component of the hinge follows a helical path with respect to other hinge components as the hinge pivots. This can result in inaccurate cuts being made to a work-piece.

Figure 1:
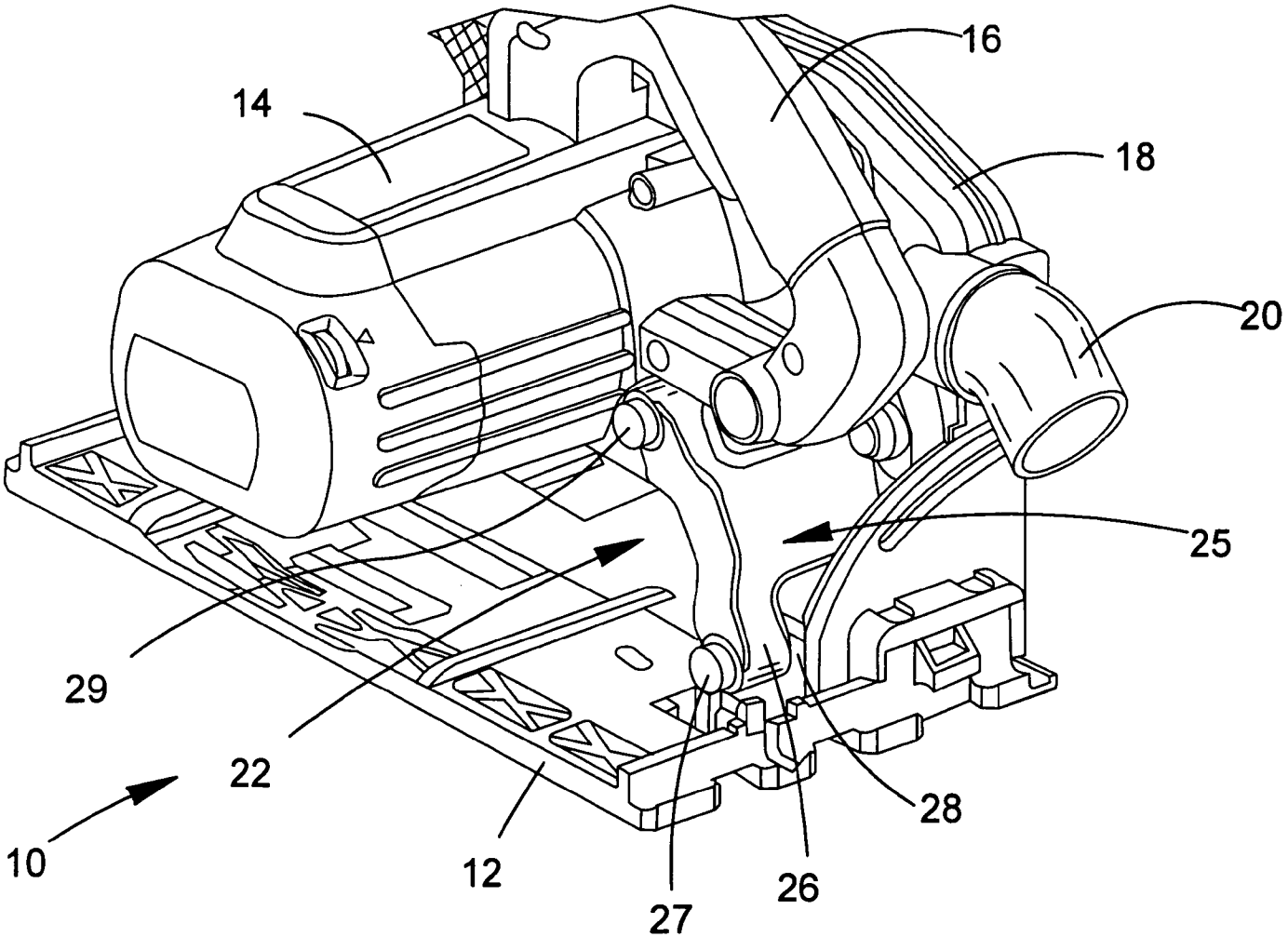
FIG. 1 is a schematic view of a saw embodying the present invention.

Referring to FIG. 1, a saw 10 embodying the present invention is shown. The saw comprises a base plate 12, a motor housing 14 moveably mounted on the base plate, a handle 16 disposed on the motor housing and a blade shroud 18 disposed on the base plate. An exhaust port 20 is arranged at one end of the shroud and is adapted to allow debris from an operating blade to exit the shroud.

A hinge mechanism 22, similar in principle to that described DE 19635527 (insofar as it comprises a double pivot hinge), is arranged to allow the motor housing to move with respect to the base plate. A lower component 25 of the hinge comprises a pivot arm 26 linking the motor housing with the base plate. A first pin 27 is arranged at a base portion of the pivot arm. The pin passes through an aperture in the pivot arm and engages with a fixed component 28 on the base plate. The pin is press fitted such that the fit between the pin and fixed component is a tolerance fit: During use the pin does not rotate or move with respect to the fixed component on the base plate. Similarly, a second pin 29 is arranged at the other end of the pivot arm and couples the pivot arm to the motor housing.

Figure 2:
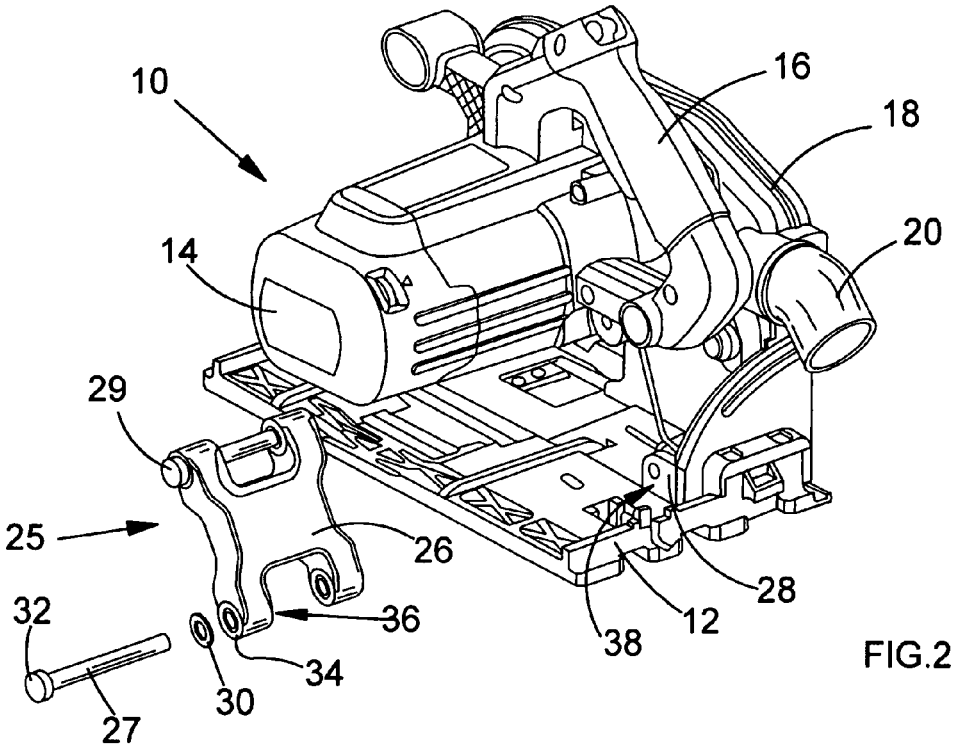
FIG. 2 is an exploded view of some components of the saw shown in FIG. 1.

Referring now to FIG. 2, an exploded view of some of the hinge components is shown. A spring washer 30 is arranged to fit between the large diameter head 32 of the pin and a surface 34 of the pivot arm. Thus, when the pin is disposed in the fixed component of the base plate, it can be pressed into the fixed component to an extent where the spring washer becomes compressed. As a result, the resilience of the washer urges an inner surface 36 of the pivot arm against a side surface 38 of the fixed component.

Figure 3:
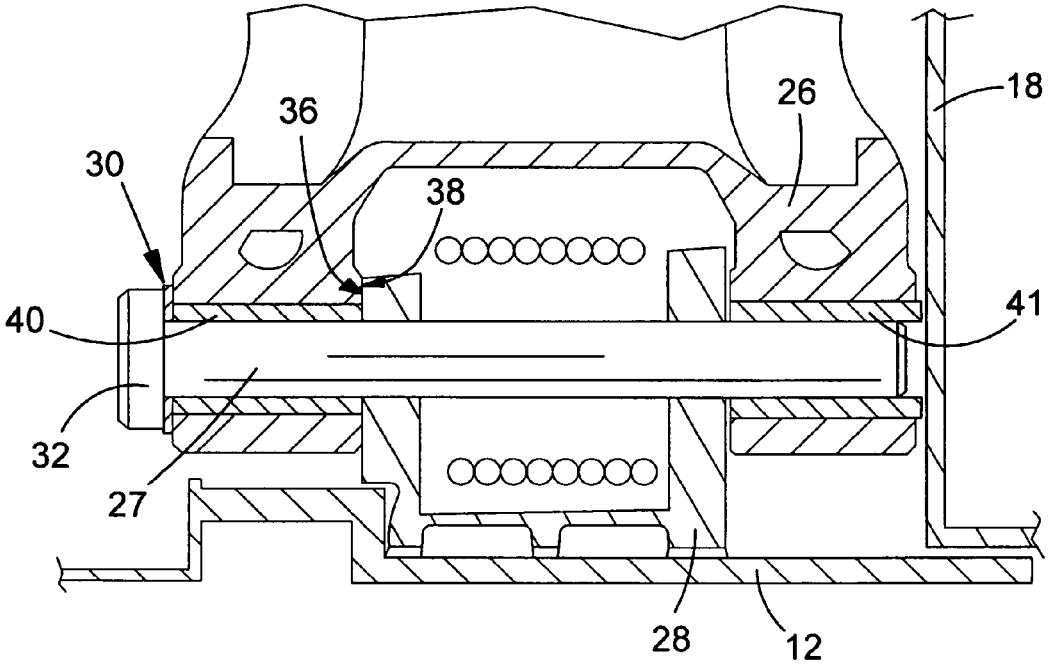
FIG. 3 is a cross sectional view of some components shown in FIG. 1.

Referring now to FIG. 3, a cross sectional view of the base portion and fixed component of the hinge is shown. The pin 27 is press fitted into the fixed component as described above. A brass sheath 40 and 41 can be fitted between the pin and the pivot arm. The sheaths allow relatively free rotational movement of the pivot arm with respect to the pin.

We have found that the force exerted by the washer should be in the range of 20N to 100N, preferably between 50N to 75N and ideally 60N. A force greater than this range can cause the operator to feel resistance as the saw is plunged. Forces applied by the washer which are less than this range do not provide an effective means to prevent axial end flow if the operator exerts a lateral force during plunging; the operator can overcome the spring force exerted by the washer relatively easily if the spring force is less than this range.

Other embodiments of the present invention will be envisaged by the skilled person without leaving the scope of the present invention. For instance, other resilient means, such as a coil spring can be used to urge the hinge components together.

What is claimed is:

1. An electrically powered, hand-held circular saw, comprising:

a housing for accommodating a motor;

a base plate having a bottom surface arranged to engage with at least one of a workpiece and a guide rail;

a hinge mechanism arranged to couple the housing to the base plate such that the housing is moveable relative to the base plate, the hinge mechanism comprising:

at least one arm configured at a first end to moveably couple to the base plate and at a second end to moveably couple to the motor housing, a pin received in an aperture at the first end of the arm and configured to engage a fixed component of the base plate, and a resilient member positioned between the pin and the first end of the arm and arranged to urge a surface of the first end of the arm against a surface of the fixed component.

2. A hinge mechanism arranged to movably couple a circular saw motor housing to a circular saw base plate, the hinge mechanism comprising:

at least one arm configured at a first end to moveably couple to the base plate and at a second end to moveably couple to the motor housing, a pin received in an aperture at the first end of the arm and configured to engage a fixed component of the base plate, and a resilient member positioned between the pin and the first end of the arm and arranged to urge a surface of the first end of the arm against a surface of the fixed component.

* * * * *